US006623138B1

(12) United States Patent
Hsu

(10) Patent No.: US 6,623,138 B1
(45) Date of Patent: Sep. 23, 2003

(54) CEILING FIXTURE

(75) Inventor: Kevin Hsu, Taichung (TW)

(73) Assignee: Dong Guan Bright Yin Huey Lighting Co., Ltd., Guang Dong (CN)

( * ) Notice: Subject to any disclaimer, the term of this patent is extended or adjusted under 35 U.S.C. 154(b) by 0 days.

(21) Appl. No.: 10/337,328

(22) Filed: Jan. 7, 2003

(51) Int. Cl.[7] ..... F21V 21/02

(52) U.S. Cl. ..... 362/147; 362/363; 362/404; 362/368; 362/311; 362/351

(58) Field of Search ..... 362/145, 147, 362/148, 311, 351, 363, 368, 404

(56) References Cited

U.S. PATENT DOCUMENTS 5,034,869 A * 7/1991 Choi ..... 362/363

5,491,618 A * 2/1996 Vakil ..... 362/147

* cited by examiner

*Primary Examiner*—Laura K. Tso

(74) *Attorney, Agent, or Firm*—Rosenberg, Klein & Lee

(57) ABSTRACT

An improved ceiling feature and particularly a ceiling feature that can be installed easily to anchor a holding dish. It mainly includes a ceiling plate fastened to the ceiling for engaging with a bolt. The holding dish may be coupled with the bolt in the direction of the ceiling. By depressing a stem end of a fastening means, an elastic plate set and a tongue may be moved thereby the tongue may be latched on a screw thread pitch of the bolt to anchor the holding dish without dropping. Then a glass shade and a cap may be coupled and a nut may be fastened to hold the ceiling feature securely.

4 Claims, 9 Drawing Sheets

CEILING FIXTURE

BACKGROUND OF THE INVENTION

1. Field of the Invention

The invention relates to an improved ceiling fixture and particularly a ceiling fixture that has an elastic plate to latch on the screw thread pitch to anchor a holding dish to facilitate installation of a ceiling lamp.

2. Description of the Prior Art

Conventional ceiling fixtures now available on the market are generally constructed as the one shown in FIGS. 1, 2 and 3. It mainly includes a ceiling plate 2 fastening to a preformed cavity 11 on the ceiling 1 through screws 21. A holding dish 31 is fastened to the ceiling plate 2 for coupling with a ceiling lamp 3 through fastening screws 22. The holding dish 31 has fastening holes 311 to receive the fastening screws 22 which are screwed to anchor the holding dish 31. Then a bolt 32 is provided with one end screwing in a screw hole 312 formed on the holding dish 31 and another end coupling with a glass shade 33 and a cap 34. Finally a nut 35 is provided to couple with the bolt 32 to complete the assembly of the ceiling lamp 3. Such a construction has the following disadvantages:

1. Before installation, the fastening screws 22 must be fastened to the ceiling plate 2. Next, the holding dish 31 is coupled from the lower side to the upper side, and the fastening holes 311 of the holding dish 31 are coupled with the fastening screws 22. The holding dish 31 is turned for positioning at a desired location. Then the fastening screws 22 are tightened. Although the actions mentioned above can fasten the holding dish 31 to the ceiling plate 2, they involve many cumbersome operations. Moreover, the ceiling plate 2 usually is installed on the ceiling which is high above the floor, people have to climb and work on an elevated location, and have to turn and tighten the fastening screws 22 while holding the holding dish 31 with one hand. It is an inefficient operation.

2. When the holding dish 31 is fastened to the ceiling plate 2, and the bolt 32 is fastened to the screw hole 312 of the holding dish 31, the glass shade 33 and the cap 34 have to be fastened by the nut 35. As the glass shade 33 is quite heavy and is supported merely by the bolt 32 fastening to the holding dish 31 which in turn is fastened to the ceiling plate 2 through fastening screws 22, to bear such a heavy load by means of such a support structure is quite risky in the long run.

SUMMARY OF THE INVENTION

In view of the aforesaid disadvantages, the primary object of the invention is to provide an improved ceiling fixture that has a stronger support to bear the heavy weight of the ceiling lamp and is easier to install.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
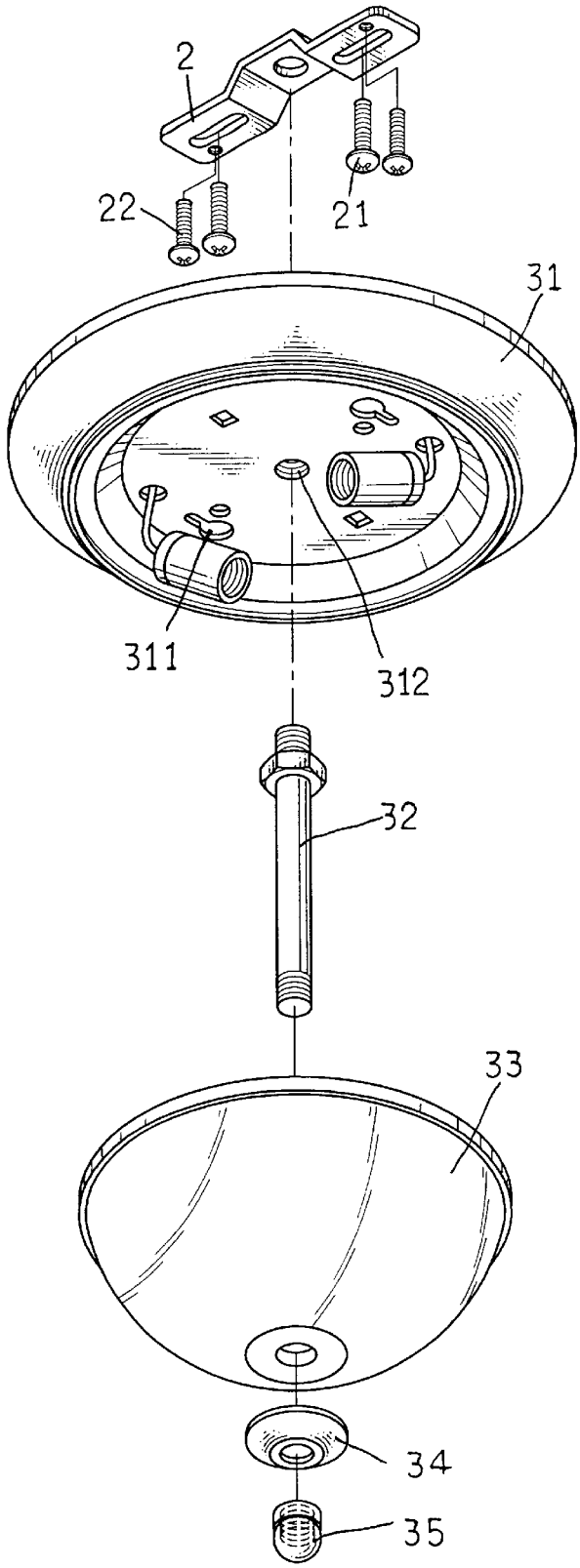
FIG. 1 PRIOR ART
FIG. 1 is an exploded view of a conventional ceiling fixture.
Figure 2:
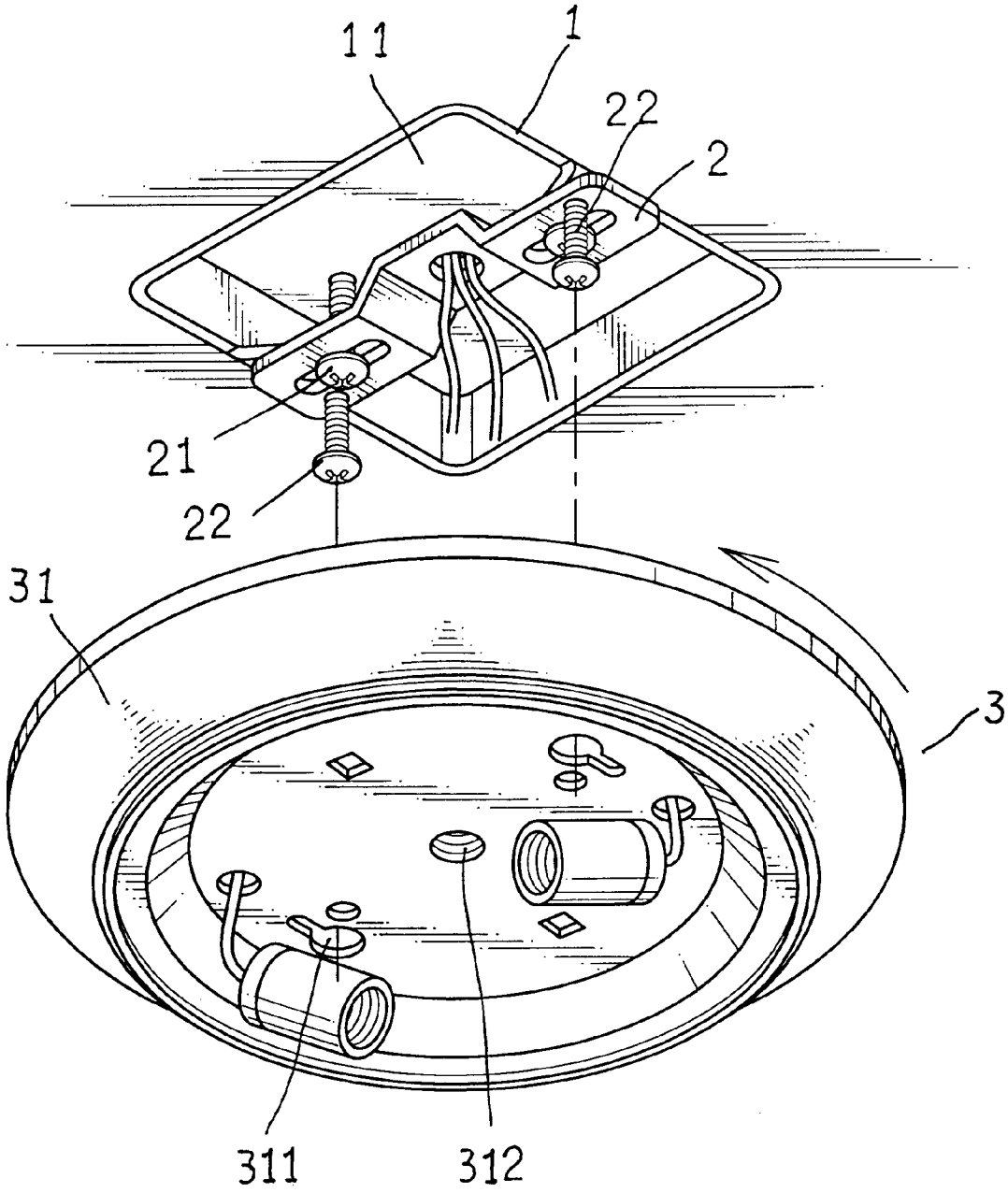
FIG. 2 PRIOR ART
FIG. 2 is a schematic view of a conventional ceiling plate and a holding dish.
Figure 3:
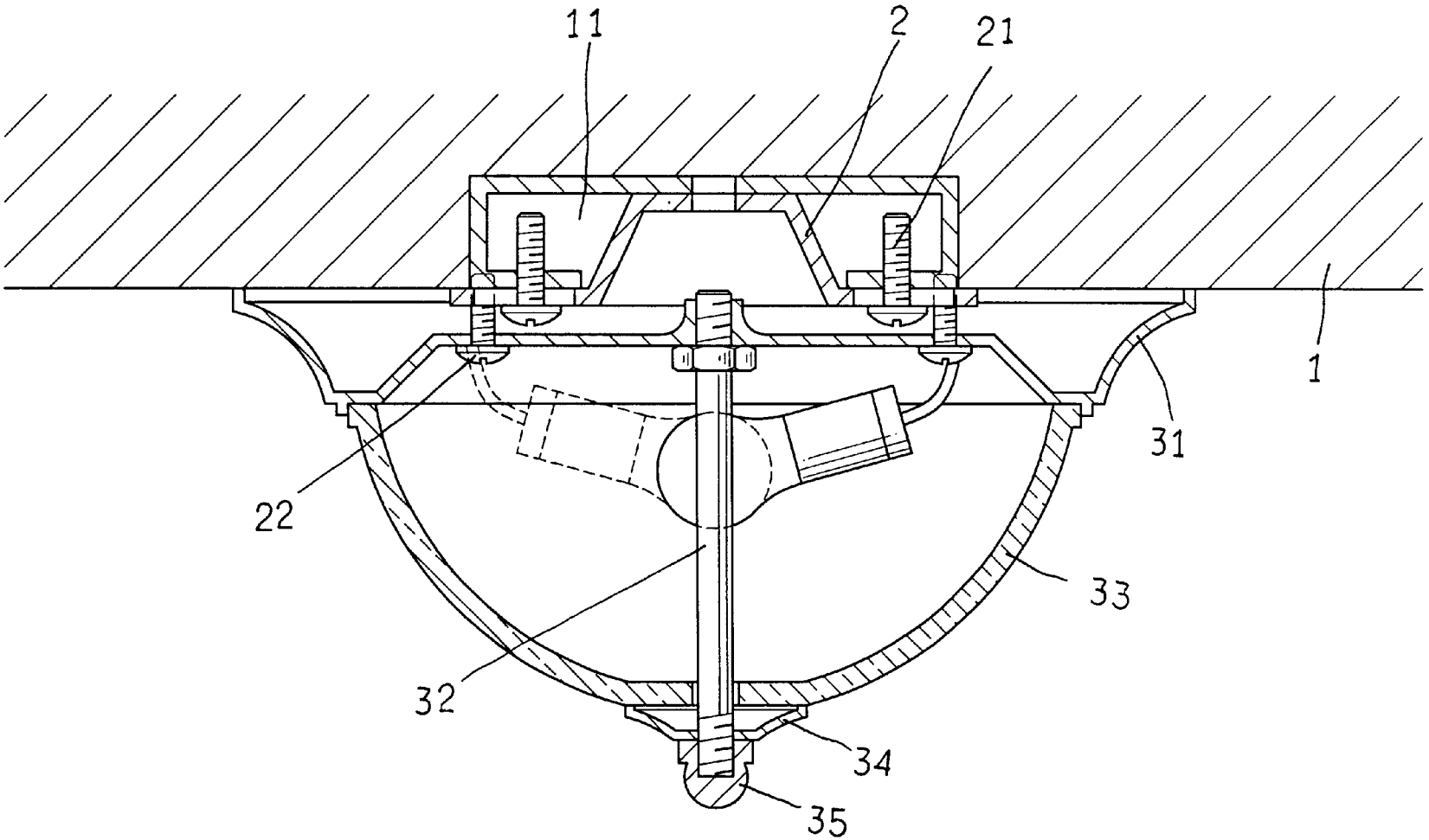
FIG. 3 PRIOR ART
FIG. 3 is a sectional view of a conventional ceiling fixture.
Figure 4:
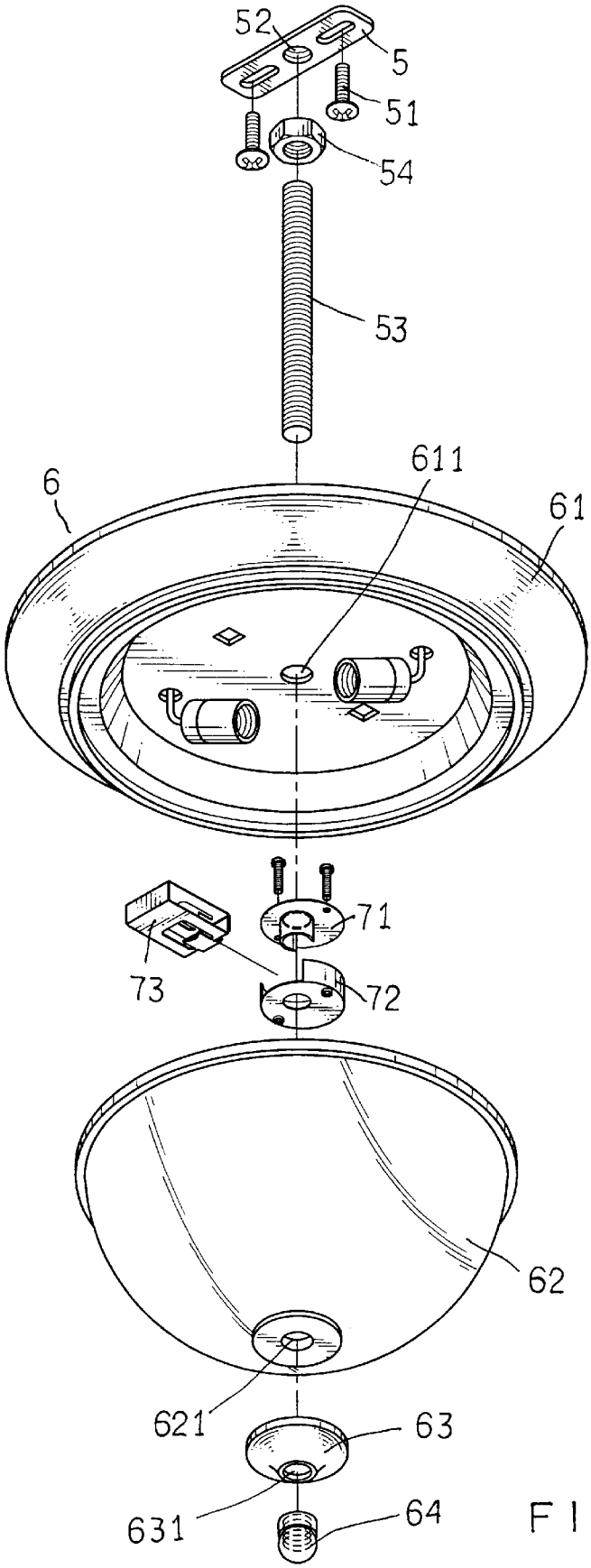
FIG. 4 is an exploded view of the invention.
Figure 5:
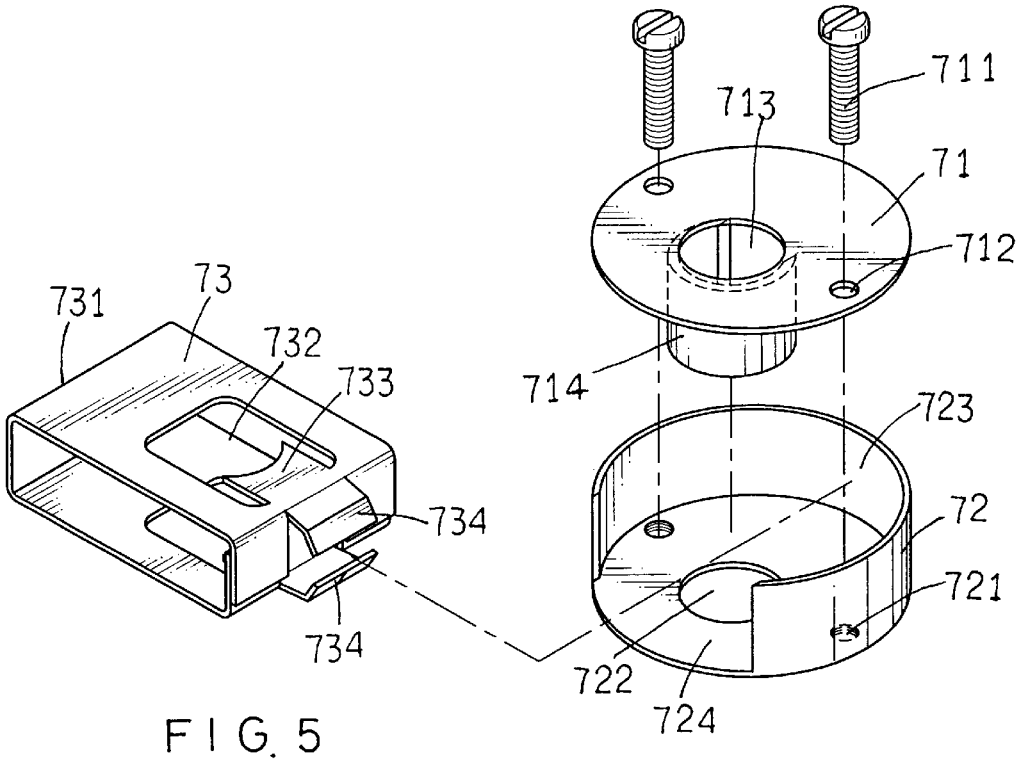
FIG. 5 is an exploded view of the fastening means of the invention.
Figure 6:
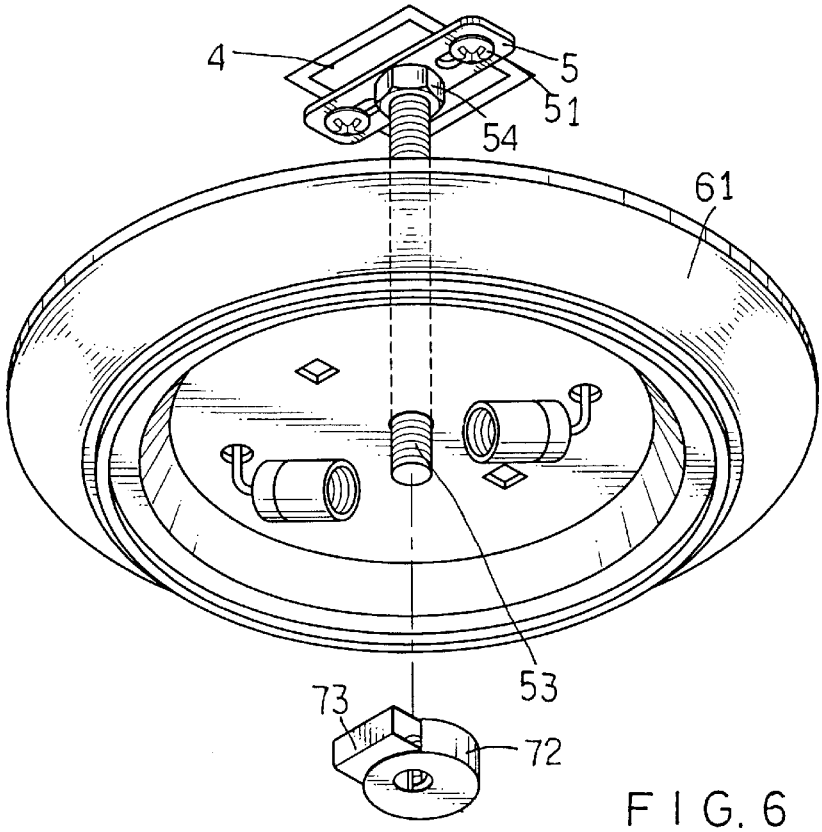
FIG. 6 is a schematic view of a ceiling plate and a holding dish of the invention.

Referring to FIGS. 4, 5 and 6, the invention mainly includes a ceiling plate 5 fastened to the ceiling 4 through screws 51. The ceiling plate 5 has a screw hole 52 to engage with a bolt 53. The bolt 53 is coupled with a fastening nut 54 for fastening the bolt 53 in the screw hole 52.

There is a ceiling lamp 6 which includes a holding dish 61, a glass shade 62, a cap 63 and a nut 64. The holding dish 61 has an opening 611 to enable the bolt 53 to run through. The glass shade 62 and the cap 63 have respectively an aperture 621 and 631 to allow the bolt 53 to run through. The bolt 53 is engaged with the nut 64 for holding the glass shade 62 and the cap 63.

A fastening means 7 is provided between the holding dish 61 and the glass shade 62. The fastening means 7 includes an upper lid 71 which has apertures 712 to receive screws 711 to engage with screw holes 721 formed on a switch box 72. The switch box 72 has a notch 724 on one side and a housing chamber 723 formed in the interior. The upper lid 71 and the switch box 72 have respectively a first opening 713 and a second opening 722. The upper lid 71 further has a C-shaped flange 714 extending downwards from the peripheral rim of the first opening 713. The housing chamber 723 may house an elastic plate set 73. The elastic plate set 73 has a stem end 731 on one side extending outside the housing chamber 723, an opening 732, a tongue 733 located on another side opposite to the stem end 731 and extended into the opening 732, and an elastic reed 734 located respectively on an upper side and a lower side of another end thereof. The opening 732 apart from the tongue 733 may house the C-shaped flange 714 of the upper lid 71.

Figure 7:
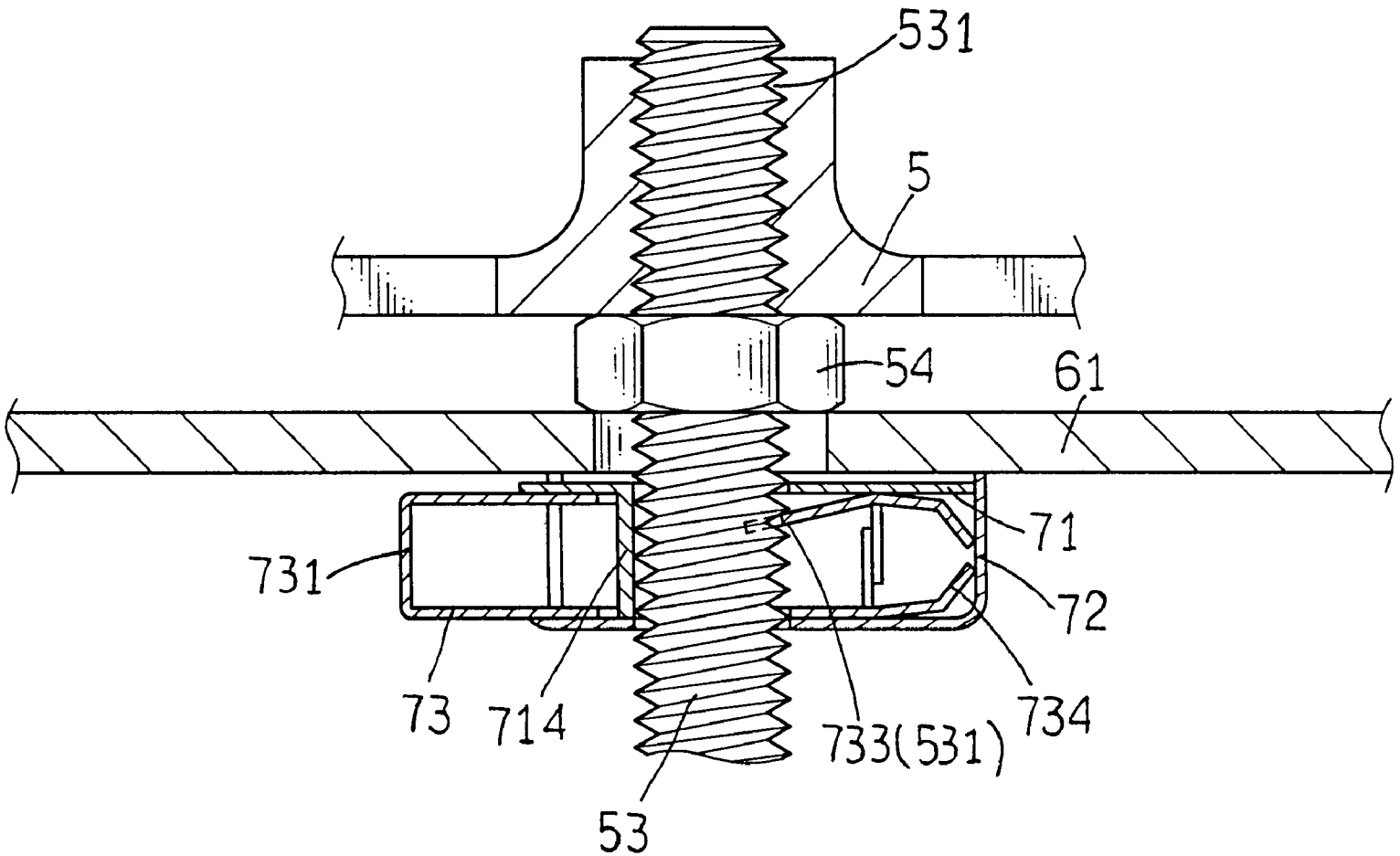
FIG. 7 is a fragmentary sectional view of the fastening means coupling with a bolt according to the invention.
Figure 8:
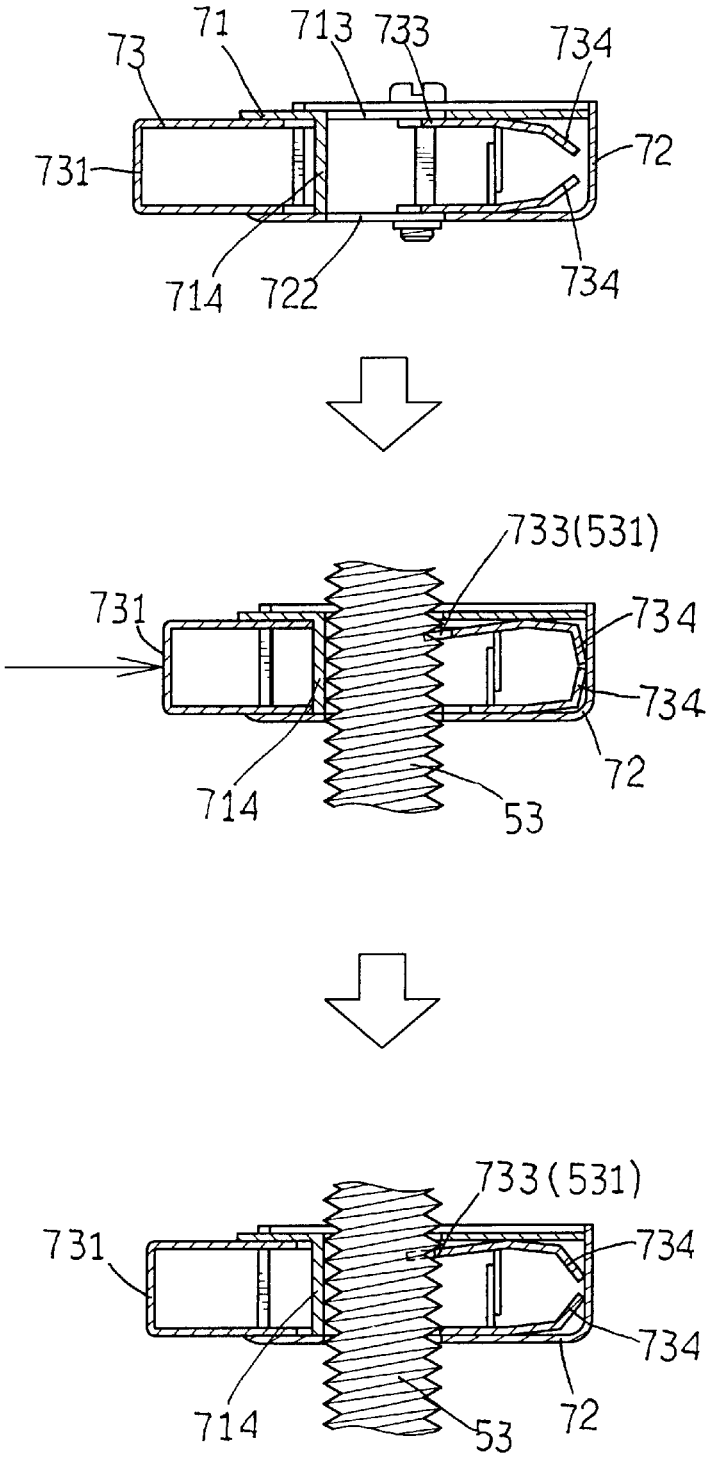
FIG. 8 is a schematic view of the elastic plate of the invention in various assembly conditions.
Figure 9:
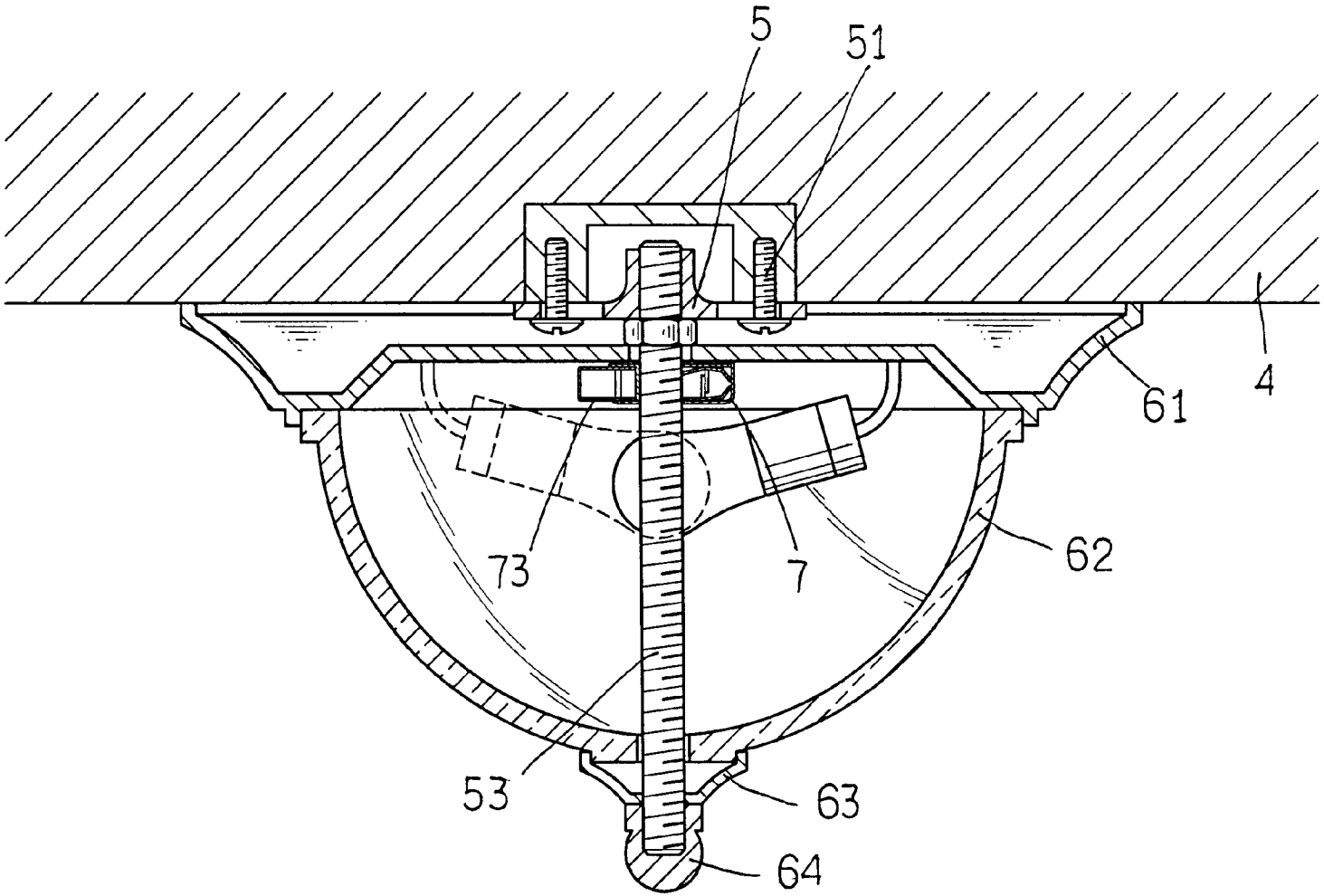
FIG. 9 is a sectional view of the invention after assembled.

Referring to FIGS. 7, 8 and 9, for assembling and installing the ceiling lamp 6, first, engage the bolt 53 with the screw hole 52 of the ceiling plate 5 and fasten the fastening nut 54 tightly to anchor the bolt. Next, fasten the ceiling plate 5 to the ceiling 4, then couple the holding dish 61 on the bolt 53. Dispose the elastic plate set 73 in the housing chamber 723 with the C-shaped flange 714 of the upper lid 71 housed in the opening 732. Engage the screws 711 in the housing chamber 723 of the switch box 72. Depress the stem end 731 and compress the elastic reeds 734 of the elastic plate set 73 to move the tongue 733 for a selected displacement so that the fastening means 7 may be coupled on the bolt 53 through the first opening 713, C-shaped flange 714 and second opening 722 of the switch box 72. Once the fastening means 7 is located on a desired position, release the stem end 732, the elastic force of the elastic reed 734 (at that moment, one end of the elastic reed 734 is pressing on the inner side of the housing chamber 723) pushes the elastic plate set 73 to its original position (as shown in FIG. 8). Thus the tongue 733 is latched on a screw thread pitch 531 of the bolt 53, and the holding dish 61 is anchored without dropping. Then the glass shade 62 and the cap 63 may be coupled on the bolt 53 in this order, and the nut 64 may be coupled with the bolt for fastening.

By means of the aforesaid construction, users may fasten the ceiling plate 5 coupled on the bolt 53 to the ceiling 4. Then the holding dish 61 may be coupled on the bolt 53. Meanwhile depress the stem end 731 of the elastic plate set 73 to compress the elastic reed 734 in the housing chamber 723 to move the tongue 733 so that the bolt 53 may run through the fastening means 7. When the fastening means 7 reaches the desired location, release the stem end 731, the holding dish 61 may be anchored securely. Then the glass shade 62 and the cap 63 may be coupled and fastened to complete the installation.

Figure 10:
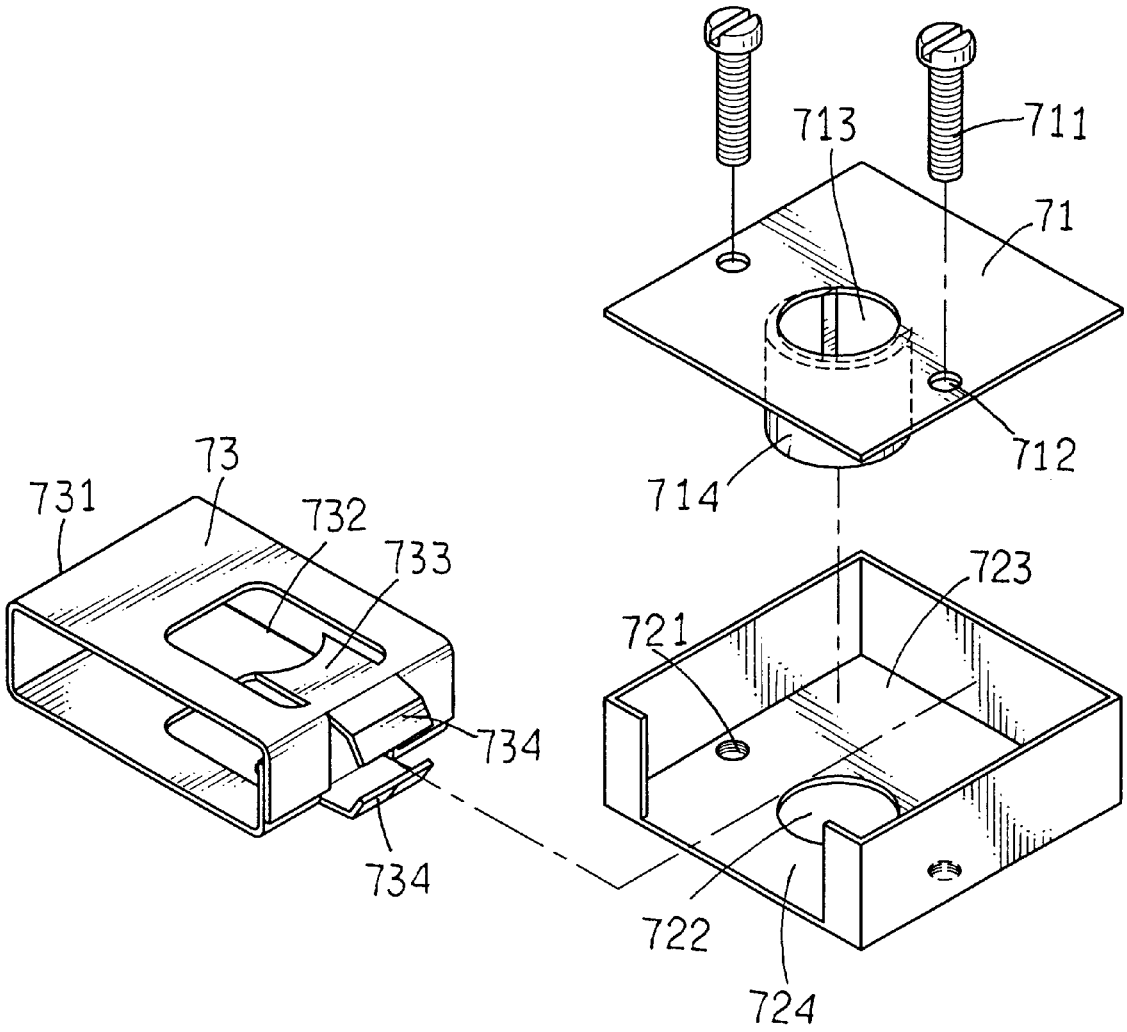
FIG. 10 is an exploded view of another embodiment of the fastening means of the invention.

FIG. 10 illustrates another embodiment of the fastening means 7 of the invention that has an altered exterior shape according to the requirement of the ceiling lamp 6.

In summary, by means of the structure and the elastic plate set provided by the invention, installation of the ceiling lamp is much easier. Even general consumers can do it without difficulty. And the risky tasks of climbing to a high place to fasten the screws are no longer necessary.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

I claim:

1. An improved ceiling fixture, comprising:

a ceiling plate fastened to a ceiling through screws having a screw hole to engage with a bolt, the bolt being engaged with a fastening nut for fastening in the screw hole;

a ceiling lamp including a holding dish, a glass shade, a cap and a nut, the holding dish having an opening to allow the bolt to run through; and a fastening means located between the holding dish and the glass shade including an upper lid and a switch box that are coupled together to form a housing chamber for holding an elastic plate set, the elastic plate set having a stem end on one side thereof extending outside the housing chamber, an opening, an upper tongue and a lower tongue located on another side thereof opposite to the stem end and extended into the opening, a C-shaped flange located in the opening corresponding to the tongues, and an elastic reed located on one end thereof.

2. The improved ceiling fixture of claim 1, wherein the tongues and the C-shaped flange form a diameter greater than that of the bolt after the elastic plate set was depressed.

3. The improved ceiling fixture of claim 1, wherein the tongues are latched on screw thread pitches of the bolt after the elastic plate set were released.

4. The improved ceiling fixture of claim 1, wherein the elastic reed has one end pressing an inner side of the housing chamber when depressed.

* * * * *